US012385238B2

(12) United States Patent
Cruz et al.

(10) Patent No.: US 12,385,238 B2
(45) Date of Patent: Aug. 12, 2025

(54) CHILD SHOWER SYSTEM

(71) Applicants: Nycula Maria Cruz, Griffin, GA (US); Jenesis Peterson, Griffin, GA (US)

(72) Inventors: Nycula Maria Cruz, Griffin, GA (US); Jenesis Peterson, Griffin, GA (US)

( * ) Notice: Subject to any disclaimer, the term of this patent is extended or adjusted under 35 U.S.C. 154(b) by 170 days.

(21) Appl. No.: 18/456,609

(22) Filed: Aug. 28, 2023

(65) Prior Publication Data

US 2024/0068210 A1 Feb. 29, 2024

Related U.S. Application Data

(60) Provisional application No. 63/402,676, filed on Aug. 31, 2022.

(51) Int. Cl.
*E03C 1/04* (2006.01)

(52) U.S. Cl.
CPC ..... *E03C 1/0408* (2013.01); *E03C 1/0403* (2013.01)

(58) Field of Classification Search
CPC ..... E03C 1/0408; E03C 1/0409; E03C 1/06; E03C 1/063
See application file for complete search history.

(56) References Cited

U.S. PATENT DOCUMENTS 2,216,149 A * 10/1940 Weiss ..... E03C 1/06 248/205.5
3,375,532 A * 4/1968 Gellmann ..... E03C 1/06 4/570
4,951,329 A * 8/1990 Shaw ..... A47K 3/001 4/615
5,749,552 A 5/1998 Fan
6,782,567 B1 * 8/2004 Austin ..... A63H 23/10 4/615
7,000,265 B2 * 2/2006 Faisst ..... E03C 1/06 4/615
7,293,302 B2 * 11/2007 Mesa ..... A47K 3/28 4/601
7,937,784 B2 5/2011 Qiu
8,191,185 B2 * 6/2012 Tsai ..... E03C 1/066 4/615
8,627,850 B1 1/2014 Booker
9,273,451 B2 3/2016 Brunoli
9,533,313 B2 * 1/2017 Anderson ..... B05B 1/207
11,096,475 B2 * 8/2021 Lentz ..... A46B 11/063
12,203,251 B1 * 1/2025 Lin ..... B05B 1/18
2008/0259056 A1 10/2008 Freier et al.
2011/0031331 A1 2/2011 Klicpera

* cited by examiner

*Primary Examiner* — Erin Deery
(74) *Attorney, Agent, or Firm* — Boudwin Intellectual Property Law, LLC; Daniel Boudwin

(57) ABSTRACT

A child showering system with an adjustable shower head and a temperature adjustment knob positioned to be in reach of a child while in the shower. The child showering system includes a water temperature adjust is be positioned below the adjustable arm on the front surface of the housing. The child showering system includes a swivel for a child shower attachment and a pair of shower heads. There is also a multicolor lighting system that extends along the perimeter of the housing and provides illumination of the housing to enhance a user's vision.

19 Claims, 4 Drawing Sheets

CHILD SHOWER SYSTEM

CROSS REFERENCE TO RELATED APPLICATIONS

This application claims the benefit of U.S. Provisional Application No. 63/402,676 filed on Aug. 31, 2022. The above identified patent application is herein incorporated by reference in its entirety to provide continuity of disclosure.

BACKGROUND OF THE INVENTION

The present invention relates to a system. More particularly, the present invention relates to a child shower system.

Showering is an important aspect of personal hygiene. For young children, it may be difficult for them to operate a shower. Due to the height of the shower head and the temperature adjustment knob in most showers, the children are unable to adjust the shower head or the adjustment knob to have a comfortable experience. If a child attempts to adjust either the shower head or the temperature knob out of reach, they could end-up severely injury themselves in the process.

Thus, it is common for the parents to assist the child in showering by adjusting both the shower head and the temperature knob according. However, a parent may have to constantly adjust both features of the shower to the child's desire. There are shower heads that may be removed from a support holder which may bring the water flow closer to the child, however it may be difficult for smaller children to operate these types of shower heads to have an effective shower. This may leave the parents opting to bathe the child in a bathtub as opposed to them operating the shower for the child.

Unfortunately, bathing has some negative consequences. First, that the child will be sitting in the still bathe water for an extended amount of time. The longer the child sits in the bath water, the more oils, dirt, and other debris accumulate therein from the child's skin. Sitting in a bathtub with such debris for an extended amount of time may result in the child suffering from a bacterial infection.

Additionally, while in the bathtub the parent must be positioned in such a way that they may reach the child to bathe them. Typically, this includes laying on the bathroom floor and extending themselves over the edge of the bathtub. It is common for a parent sitting in such a position to experience pain or cramping from being crouched down near the bathtub. Finally, most children want to begin to have some independence while in they are showering and providing them a safe way to do so will limit the concerns stated above.

In order to address these concerns, the present invention will provide users with a child shower system with a shower head and a temperature adjustment knob positioned to be in reach of a child while in the shower.

SUMMARY OF THE INVENTION

In view of the foregoing disadvantages inherent in the known types of child shower systems now present in the prior art, the present invention provides a child shower system wherein the same may be utilized for providing convenience for a user when using a child shower system.

The present system comprises a child shower system having a housing having a front surface and a rear surface, the rear surface of the housing includes one or more fasteners, a child shower attachment extending from the front surface of the housing, a water temperature adjustment knob disposed on the front surface of the housing, the water temperature adjust knob includes a plurality of identifiable settings and an actuator button, a plurality of electronic components disposed on the housing, a hose disposed on a top surface of the housing, and a shower hook-up including a pair of shower heads and a hook-up, the pair of shower heads include a first shower head and a second shower head, wherein the hook-up connects with a water line located within each of the pair of shower heads, thereby allowing the housing adapted to be removably secured to an existing shower line, and wherein the child shower attachment is affixed to an adjustable arm that moves up and down along a vertical axis.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
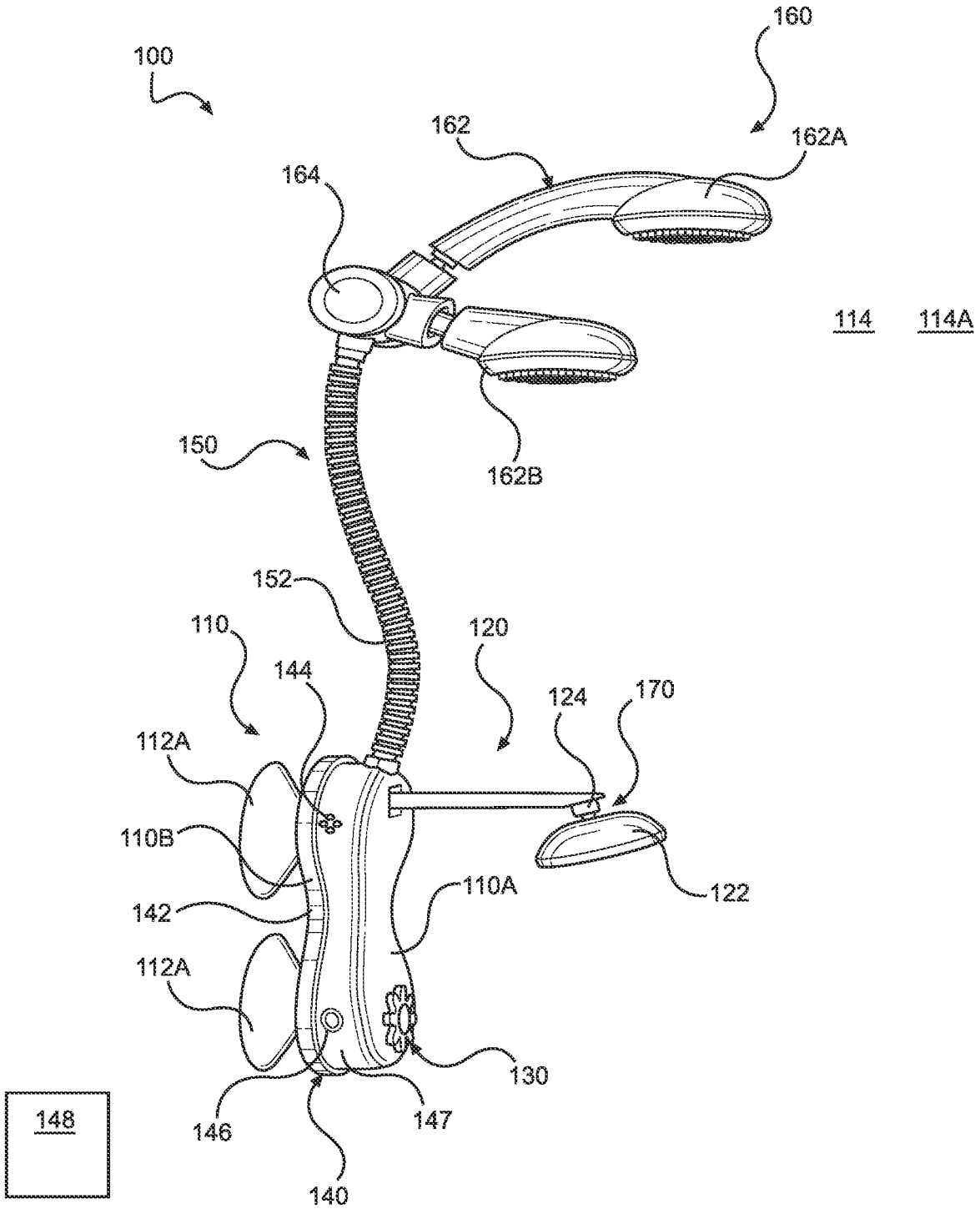
FIG. 1 shows a side perspective view of an embodiment of the child shower system.

Reference is made herein to the attached drawings. Like reference numerals are used throughout the drawings to depict like or similar elements of the child shower system. The figures are intended for representative purposes only and should not be considered to be limiting in any respect.

FIG. 1 shows a front perspective view of an embodiment of a child shower system 100.

The child shower system 100 may include a housing 110, a child shower attachment 120, a water temperature adjust 130, a plurality of electronic components 140, a hose 150, a shower hook-up 160, and a valve 170.

The housing 110 may include a front surface 110A and a rear surface 110B. The rear surface 110B of the housing 110 may include one or more fasteners 112. The one or more fasteners 112 may be adapted to secure the housing 110 to a wall 114 of a shower 114A. In the preferred embodiment, the one or more fasteners 112 may be one or more suction cups 112A or the like. FIG. 1 shows a pair of suction cups 112A.

The child shower attachment 120 may extend from the front surface 110A of the housing 110. The child shower attachment 120 may be affixed to an adjustable arm 124 that moves up and down along a vertical axis. The child shower attachment 120 may include a shower head 122 that rotates in an up-and-down fashion or a side-to-side fashion or the like.

The water temperature adjust 130 may be disposed on the front surface 110A of the housing 110. The water temperature adjust 130 may be positioned below the adjustable arm 124 on the front surface 110A of the housing 110.

The electronic components 140 may be disposed on the housing 110. The electronic components 140 may include a multicolor lighting system 142, a speaker 144, and a waterproof removable battery 146 may be inserted into a port 147 disposed on the housing 110. The multicolor lighting system 142 may extend along the perimeter of the housing 110. The multicolor lighting system 142 may provide illumination of the housing 110 to enhance a user's vision. The speaker 144 may be wirelessly connected to an electronic device 148 to emit sounds for a user while operating the child shower system 100. The waterproof removable battery 146 may allow power to the other electronic components 140.

The hose 150 may be disposed on a top surface 110A of the housing 110. The hose 150 may be a stainless steel hose 152 or the like.

The shower hook-up 160 may include a pair of shower heads 162 and a hook-up 164.

The pair of shower heads 162 may include a first shower head 162A and a second shower attachment 162B. The hook-up 164 may connect with a water line (FIG. 4, 166) located within each of the pair of shower heads 162, thereby allowing the housing 110 to be removably secured to an existing shower line (not shown). The hook-up 164 may be dispersed from the pair of shower heads 162 or within the hose 150 to the child shower attachment 120.

A valve 170 may be operably connected to the child shower attachment 120, whereupon actuation, water may be redirected from the shower line (not shown) to the child shower attachment 120 or the pair of shower heads 162.

Figure 2:
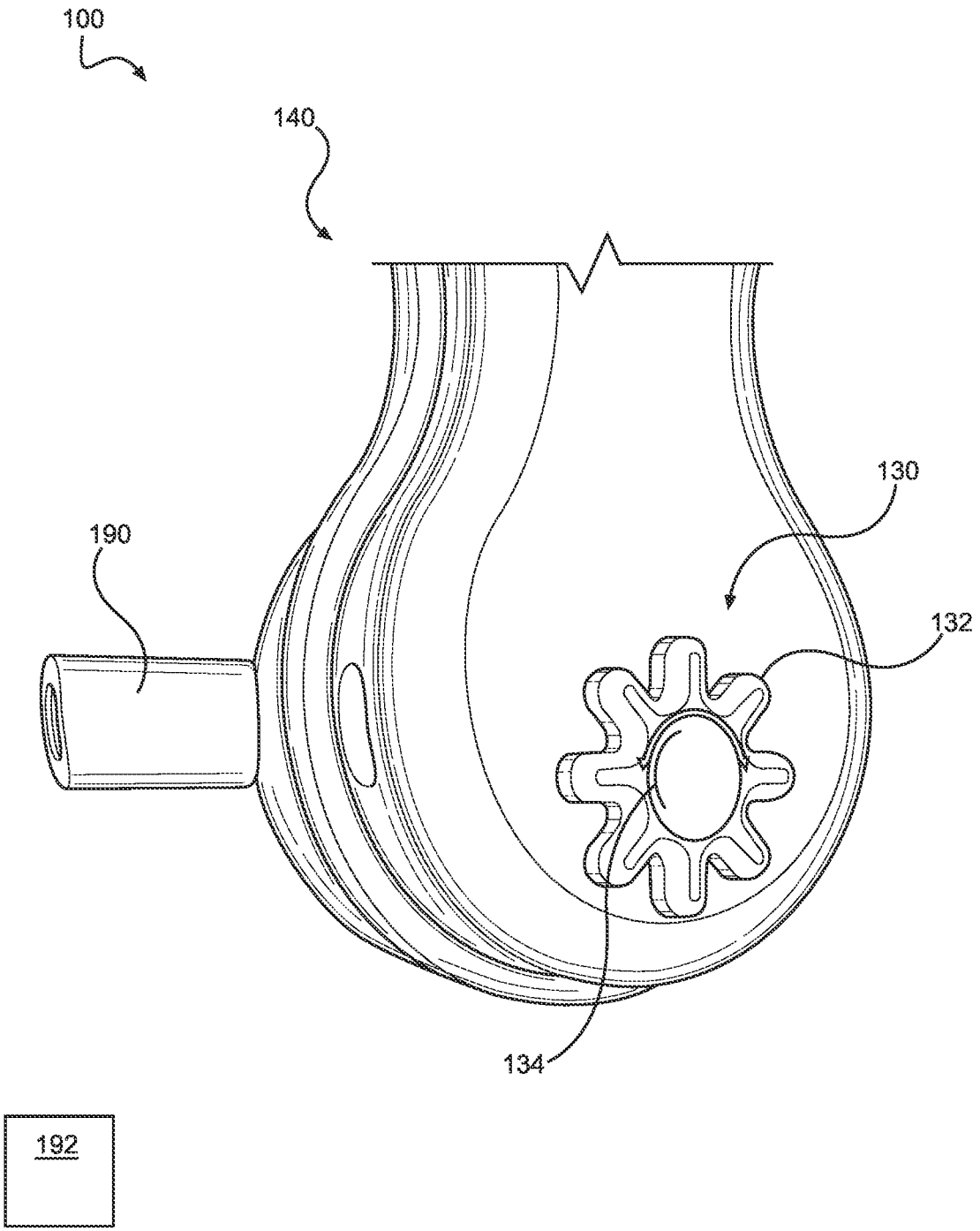
FIG. 2 shows a close-up view of an embodiment of a water temperature adjust of the child shower system.

FIG. 2 shows a close-up view of an embodiment of a water temperature adjust 130 of the child shower system 100.

The water temperature adjust 130 may include a plurality of identifiable settings 132 and an actuator button 134.

The identifiable settings 132 may be set from rotating the water temperature adjust 130 to adjust the water temperature dispensing from the child shower attachment (FIG. 1, 120). In the shown embodiment, the actuator button 134 may be centrally disposed on the water temperature adjust 130 to turn the child shower attachment 120 on or off. In one embodiment, the actuator button 134 and the water temperature adjust 130 may be combined.

The actuator button 134 may determine which path within the child shower system 100 water will flow for dispersing. In one embodiment, the actuator button 134 may be a push button 134A or the like. Additionally, the actuator button 134 may selectively adjust the temperature output from the child shower attachment 120 and selectively activate or deactivate the electronic components 140 within the housing 110.

A user may remove the waterproof removable battery 190 from the housing 110 and insert it into a universal charging station 192 when the shower 114A is not in use.

Figure 3:
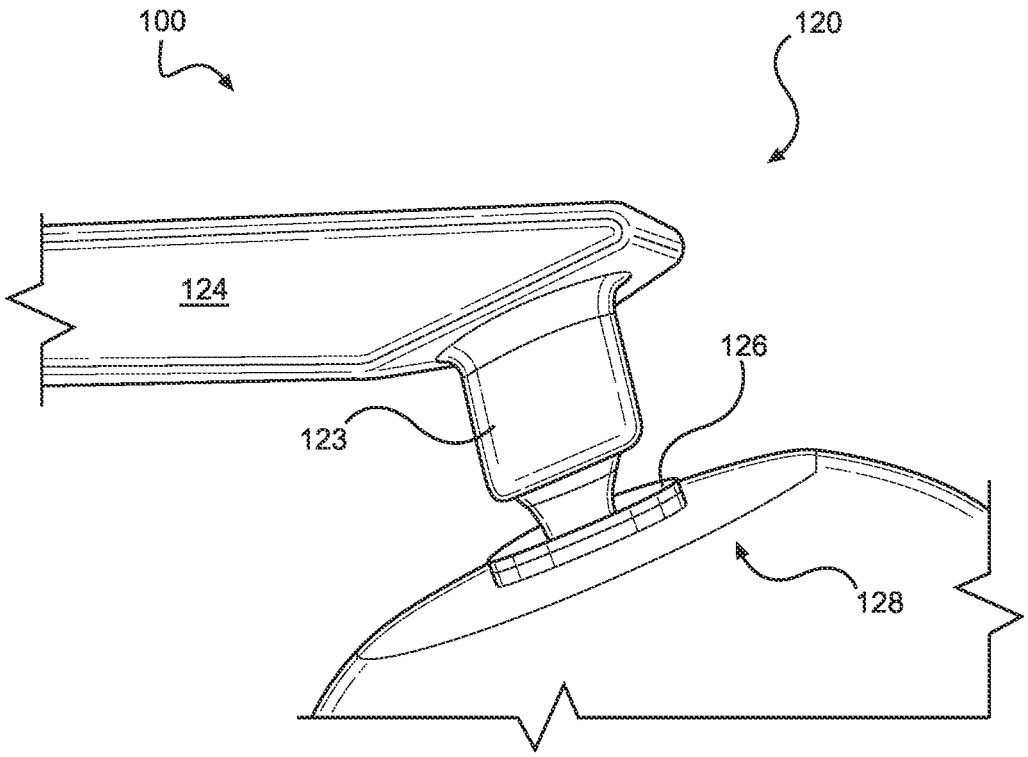
FIG. 3 shows a close-up view of an embodiment of a child shower attachment of the child shower system.

FIG. 3 shows a close-up view of an embodiment of the child shower attachment 120 of the child shower system 100.

The child shower attachment 120 may include a swivel 126, a plurality of apertures 128, and a temperature sensor 123.

The swivel 126 may pivot about a distal end of the adjustable arm 124 and is located behind the shower head 122. The swivel 126 may move the shower head 122 forward and backwards. The apertures 126 may be disposed on the shower head 122 to allow the water to be dispersed therefrom.

The temperature sensor 123 may be connected to the child shower attachment 120 and the pair of shower heads (FIG. 1, 154, 156). The temperature sensor 123 may be operably connected to an electrical device (FIG. 1, 148) via wireless communication such as the Internet, short range wireless technology or BLUETOOTH® or the like. Moreover, the temperature sensor 123 may be further configured to actuate the valve (FIG. 1, 170) to prevent fluid flow through the child shower attachment 120 if the water temperature within the shower line (not shown) exceeds a threshold temperature, such that a child using the child shower system 100 is not burned.

Figure 4:
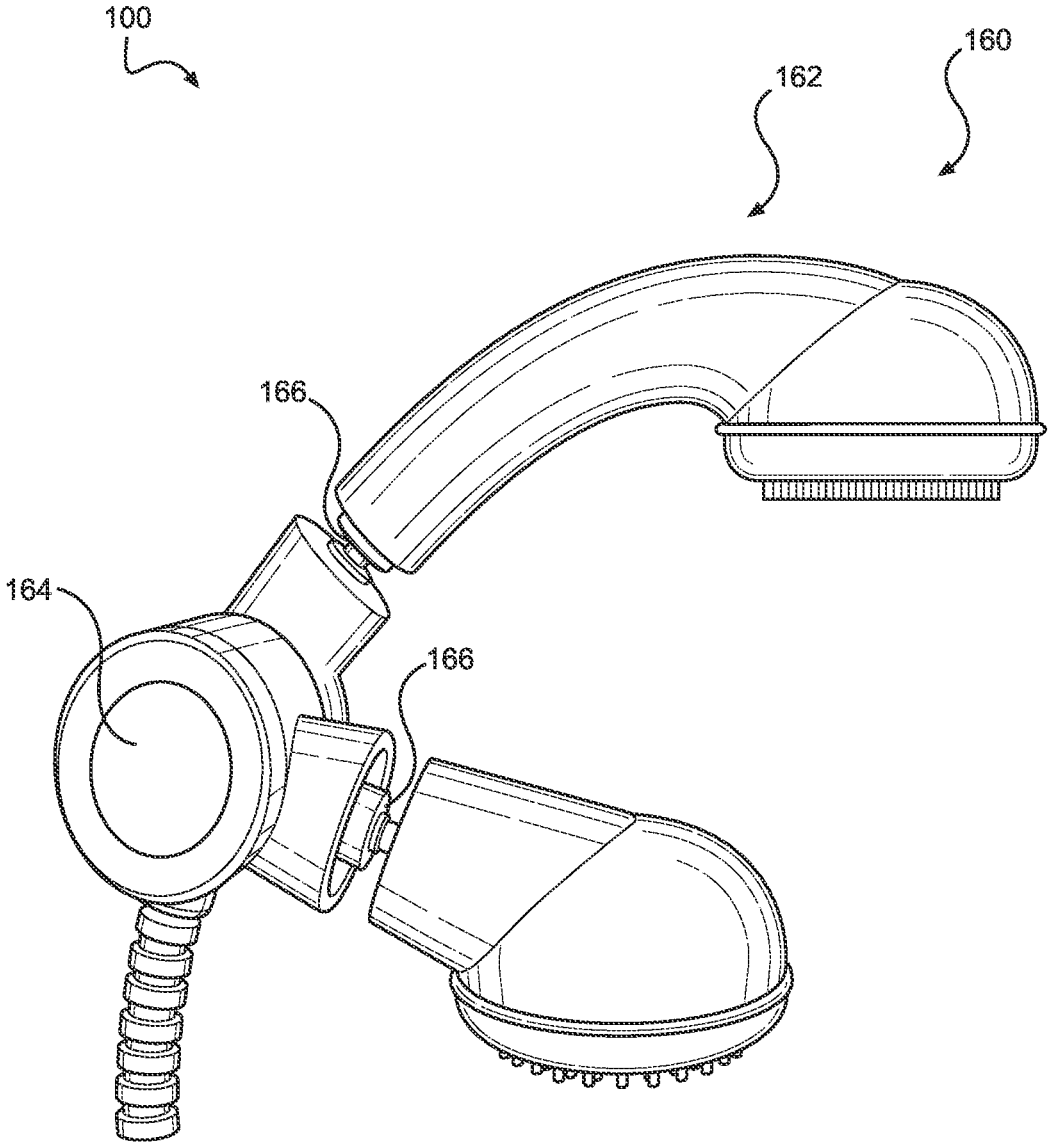
FIG. 4 shows a close-up view of an embodiment of a shower hook-up of the child shower system.

FIG. 4 shows a close-up view of an embodiment of a shower hook-up 160 of the child shower system 100. The shower hook-up 160 may pivot along a horizontal axis and a vertical axis.

The shower hook-up 160 may include a swivel 166.

The swivel 166 may disposed behind each of the pair of shower heads 162 but in front of the hook-up 164. The swivel 166 may move each of the pair of shower heads 162 back and forth and side-to-side or the like.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A child shower system, comprising:

a housing having a front surface and a rear surface, the rear surface of the housing includes one or more fasteners;

a child shower attachment extending from the front surface of the housing;

a water temperature adjustment knob disposed on the front surface of the housing, the water temperature adjustment knob includes a plurality of identifiable settings and an actuator button;

a plurality of electronic components disposed on the housing;

a hose disposed on a top surface of the housing; and a shower hook-up including a pair of shower heads and a hook-up, the pair of shower heads include a first shower head and a second shower head;

wherein the hook-up connects with a water line located within each of the first shower head and second shower head, thereby allowing the housing adapted to be removably secured to an existing shower line; and wherein the child shower attachment is affixed to an adjustable arm that moves up and down along a vertical axis.

2. The child shower system, according to claim 1, wherein the one or more fasteners are adapted to secure the housing to a wall of a shower.

3. The child shower system, according to claim 1, wherein the one or more fasteners are one or more suction cups.

4. The child shower system, according to claim 1, wherein the child shower attachment includes a shower head that rotates in an up-and-down fashion or a side-to-side fashion.

5. The child shower system, according to claim 1, wherein the child shower attachment includes a swivel, a plurality of apertures, and a temperature sensor.

6. The child shower system, according to claim 5, wherein a swivel is disposed behind each of the first shower head and the second shower head but in front of the hook-up.

7. The child shower system, according to claim 6, wherein each swivel moves a respective shower head of the pair of shower heads back and forth and side-to-side.

8. The child shower system, according to claim 5, wherein the temperature sensor is connected to the child shower attachment and the pair of shower heads.

9. The child shower system, according to claim 1, wherein the water temperature adjustment knob is positioned below the adjustable arm on the front surface of the housing.

10. The child shower system, according to claim 1, wherein the water temperature adjustment knob includes identifiable settings to adjust the water temperature dispensing from the first shower head.

11. The child shower system, according to claim 1, wherein the identifiable settings set from rotating the water temperature adjustment knob to adjust the water temperature dispensing from the child shower attachment.

12. The child shower system, according to claim 1, wherein the actuator button is centrally disposed on the water temperature adjustment to turn the child shower attachment on or off.

13. The child shower system, according to claim 1, wherein the actuator button determines which path within the child shower system water will flow for dispersing.

14. The child shower system, according to claim 1, wherein the electronic components include a multicolor lighting system, a speaker, and a waterproof removable battery inserted into a port disposed on the housing.

15. The child shower system, according to claim 14, wherein the multicolor lighting system extends along a perimeter of the housing and provides illumination of the housing to enhance a user's vision.

16. The child shower system, according to claim 14, wherein the speaker is wirelessly connected to an electronic device to emit sounds for a user while operating the child shower system.

17. The child shower system, according to claim 14, wherein the waterproof removable battery allows power to the electronic components.

18. The child shower system, according to claim 1, wherein the hose is a stainless steel gooseneck hose.

19. The child shower system, according to claim 1, wherein the hook-up disperses water to the pair of shower heads.

* * * * *